US006273055B1

(12) United States Patent
White

(10) Patent No.: US 6,273,055 B1
(45) Date of Patent: Aug. 14, 2001

(54) ROTARY ENGINE

(76) Inventor: Robert A. White, 12109 McRaven Rd., Clinton, MS (US) 39056

( * ) Notice: Subject to any disclaimer, the term of this patent is extended or adjusted under 35 U.S.C. 154(b) by 0 days.

(21) Appl. No.: 09/564,269

(22) Filed: May 4, 2000

Related U.S. Application Data

(60) Provisional application No. 60/132,442, filed on May 4, 1999.

(51) Int. Cl.[7] ..... F02B 53/04

(52) U.S. Cl. ..... 123/238; 123/213; 123/215; 123/234

(58) Field of Search ..... 123/212, 213, 123/214, 215, 221, 234, 238

(56) References Cited

U.S. PATENT DOCUMENTS

| | | | | |
|---|---|---|---|---|
| 3,574,491 | | 4/1971 | Martin | 418/205 |
| 3,699,930 | * | 10/1972 | Bunce | 123/238 X |
| 3,782,340 | | 1/1974 | Nam | 123/8.23 |
| 3,993,029 | * | 11/1976 | Eiermann et al. | 123/213 X |
| 4,265,606 | | 5/1981 | Lehnus | 418/201 |
| 4,405,286 | | 9/1983 | Studer | 417/1 |
| 4,747,762 | | 5/1988 | Fairbairn | 418/191 |
| 4,893,996 | | 1/1990 | Loran et al. | 418/99 |
| 4,912,924 | | 4/1990 | Stockwell | 60/39.45 |
| 5,222,992 | * | 6/1993 | Fleischmann | 123/238 X |
| 5,682,793 | | 11/1997 | Liao | 74/462 |

* cited by examiner

*Primary Examiner*—Hoang Nguyen
(74) *Attorney, Agent, or Firm*—Sieberth & Patty, L.L.C.

(57) ABSTRACT

A combustion engine comprised of (i) at least one compression stage, (ii) at least one combustion unit, and (iii) at least one expansion stage is described. The compression and expansion stages include tongue and groove cylindrical rotors in sealing relation to one another for fluid volume displacement and transfer of rotational force from expansion of compressed fluid volumes following combustion. Related methods of providing a rotational force to a drive shaft are also described.

24 Claims, 3 Drawing Sheets

ROTARY ENGINE

REFERENCE TO RELATED APPLICATION

This application claims the benefit of U.S. Provisional Patent Application No. 60/132,442 filed on May 4, 1999.

TECHNICAL FIELD

This invention relates to rotary combustion engines.

BACKGROUND

Over the past several decades, considerable effort has been expended to find successful alternatives to the reciprocating internal combustion engine which improve upon the features and advantages of that engine. Alternative external and internal combustion engines, e.g., the Wankel, Tri-Dyne and Stirling engines, have been developed as a part of this effort. However, so far as is known, none of the rotary engines developed heretofore have provided an efficient power source while also successfully addressing both the reduction or elimination of the accompanying vibration and noise associated with traditional reciprocating internal combustion engines and the thermodynamic problems historically associated with continuous combustion.

Thus, a need continues to exist for a continuous combustion engine which provides efficient power in a substantially quiescent manner using economically feasible materials and construction capable of withstanding the thermal conditions brought to bear during engine operation.

SUMMARY OF THE INVENTION

The present invention is deemed to satisfy this need in a highly effective and efficient manner. In one embodiment of this invention, a combustion engine is provided. The engine is comprised of at least one compression stage, at least one combustion unit, and at least one expansion stage. The compression stage is comprised of a first housing portion defining two or more overlapping cylindrical bores and two or more cylindrical compression rotors which are disposed within the first housing portion and concentrically aligned within the bores respectively so that the compression rotors are in substantially sealing relation with one another at their respective pitch diameters. The compression stage is configured to (1) receive a fluid volume through a fluid inlet in the first housing portion, (2) compress the fluid volume, and (3) convey at least a portion of the compressed fluid volume to the combustion unit. The expansion stage is comprised of a second housing portion defining two or more overlapping cylindrical bores and two or more cylindrical expansion rotors which are disposed within the second housing portion and concentrically aligned within the bores respectively so that the expansion rotors are in substantially sealing relation with one another at their respective pitch diameters. The expansion stage is configured to receive an expanding combustion volume from the combustion unit and to convey the combustion volume out of the second housing portion through an exhaust port, the combustion volume imparting a force to the expansion rotors, the force urging the expansion rotors to rotate. The second housing portion and associated expansion rotors are preferably configured to be cooled by a circulating fluid, e.g., air.

Each of the compression and expansion rotors in the engine is comprised of at least two male lobes diametrically opposed from one another, each lobe extending the entire axial length of the rotor and extending radially from the rotor axis of rotation beyond the rotor's pitch diameter so as to be in close proximity to an adjacent surface of the respective cylindrical bore. Each of the rotors of the engine further defines at least two female grooves extending inwardly toward the rotational axis from their respective rotor pitch diameter, the grooves of each rotor being diametrically opposed from one another and configured for receiving a respective lobe on the adjacent rotor. Preferably, each of the grooves is circumferentially disposed in the range of about 0° (i.e., a substantially contiguous offset) to about 90°, and more preferably about 45° to about 90°, most preferably about 90°, from an adjacent lobe. In this way, as a corresponding group of rotors rotates, the outer surfaces of the rotors at the respective pitch diameters are maintained in substantially sealing relation, the seal being substantially maintained even while the lobe of one of the rotors engages and then disengages a corresponding groove on another rotor in the group of rotors. The outermost surface of each lobe is also in sufficient proximity to the surface of the corresponding housing bore to create a seal there between. In this way, the rotors and the housing bores define a volume which is efficiently displaced with every rotation.

In a preferred embodiment, a portion of the compressed fluid volume from the compression stage is circulated through at least a portion of the second housing portion, and more preferably also through at least one of the corresponding expansion rotors. Also, it will be understood that the fluid volume displaced by the engine of this invention may be circulated through the engine via an open cycle (e.g., air in and exhaust out) or a closed cycle (e.g., recycled inert fluid, e.g., helium), as desired.

In a particularly preferred embodiment, at least one of the stages (compression and expansion) is itself multi-staged. That is, at least one of the stages is comprised of a series of two or more sub-stages, the sub-stages in each series having progressively smaller (on the compression side) or larger (on the expansion side) clearance volumes defined by the housing bores and the corresponding compression or expansion rotors therein, as applicable. In this way, the fluid volume to be compressed in the compression stage may be most efficiently compressed and the energy within the combustion volume may be efficiently converted into mechanical energy.

These and other embodiments and features of the invention will become still further apparent from the ensuing description, appended claims and accompanying drawings.

BRIEF DESCRIPTION OF THE DRAWINGS

In each of the above figures, like numerals are used to refer to like or functionally like parts among the several figures.

DETAILED DESCRIPTION OF THE INVENTION

As may now be appreciated, the present invention provides a novel engine configuration which provides continuous combustion capabilities and yet is configured to withstand the thermal stress normally associated with such combustion.

Figure 1:
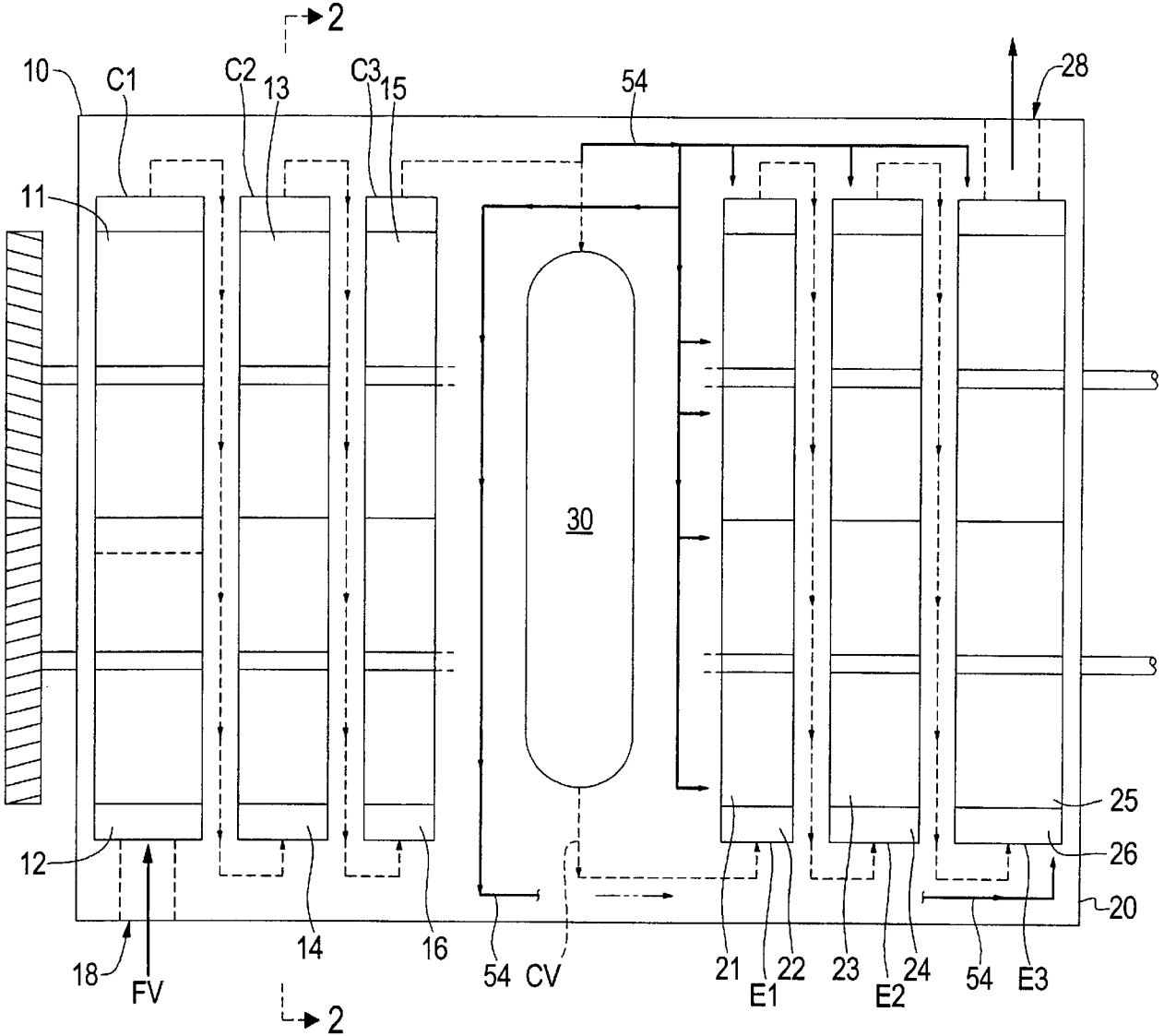
FIG. 1 is partially cross-sectional, plan view of a preferred engine of this invention.
Figure 2:
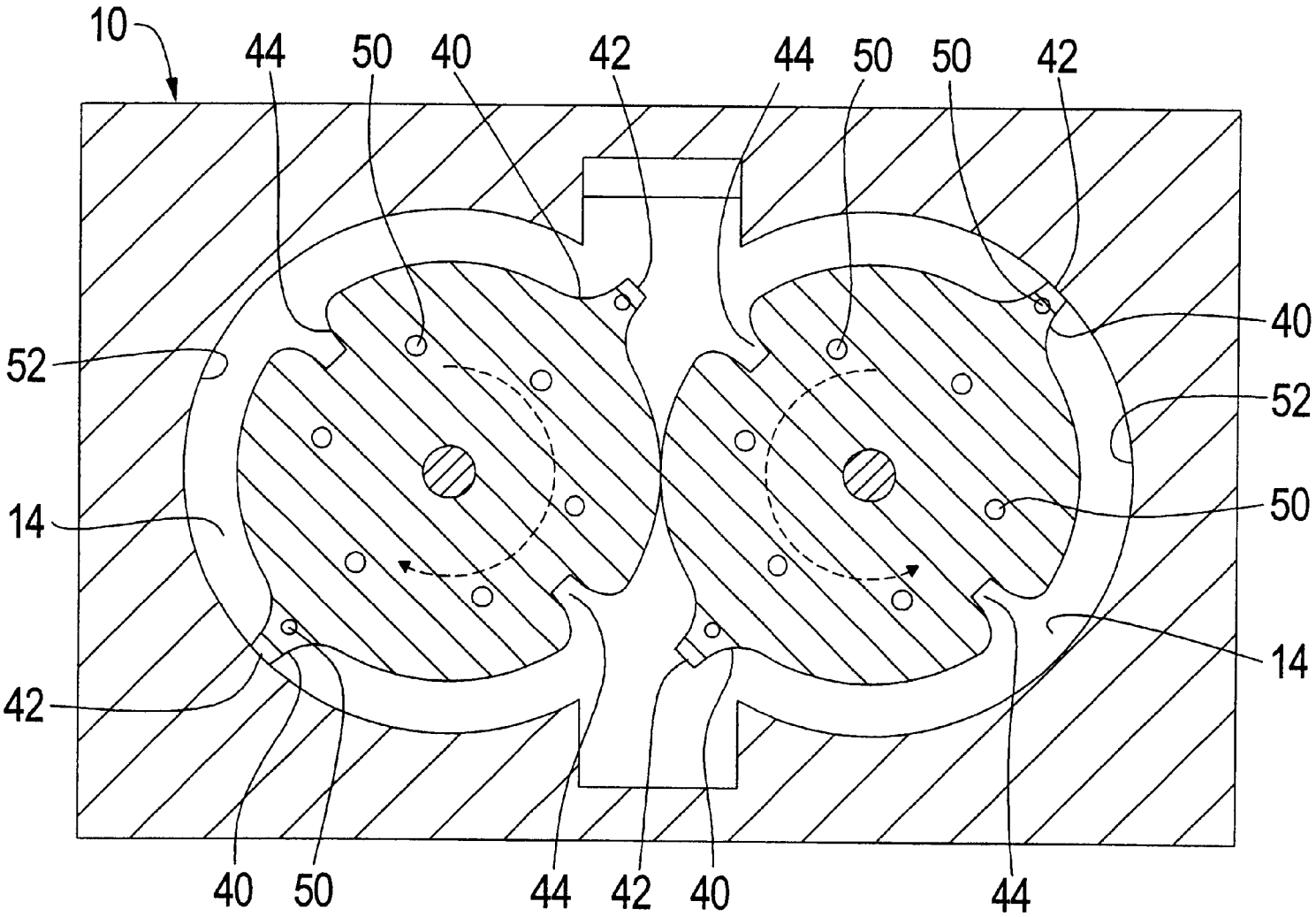
FIG. 2 is a cross-sectional view of the engine of FIG. 1 taken along line 2—2 as seen on FIG. 1.
Figure 3:
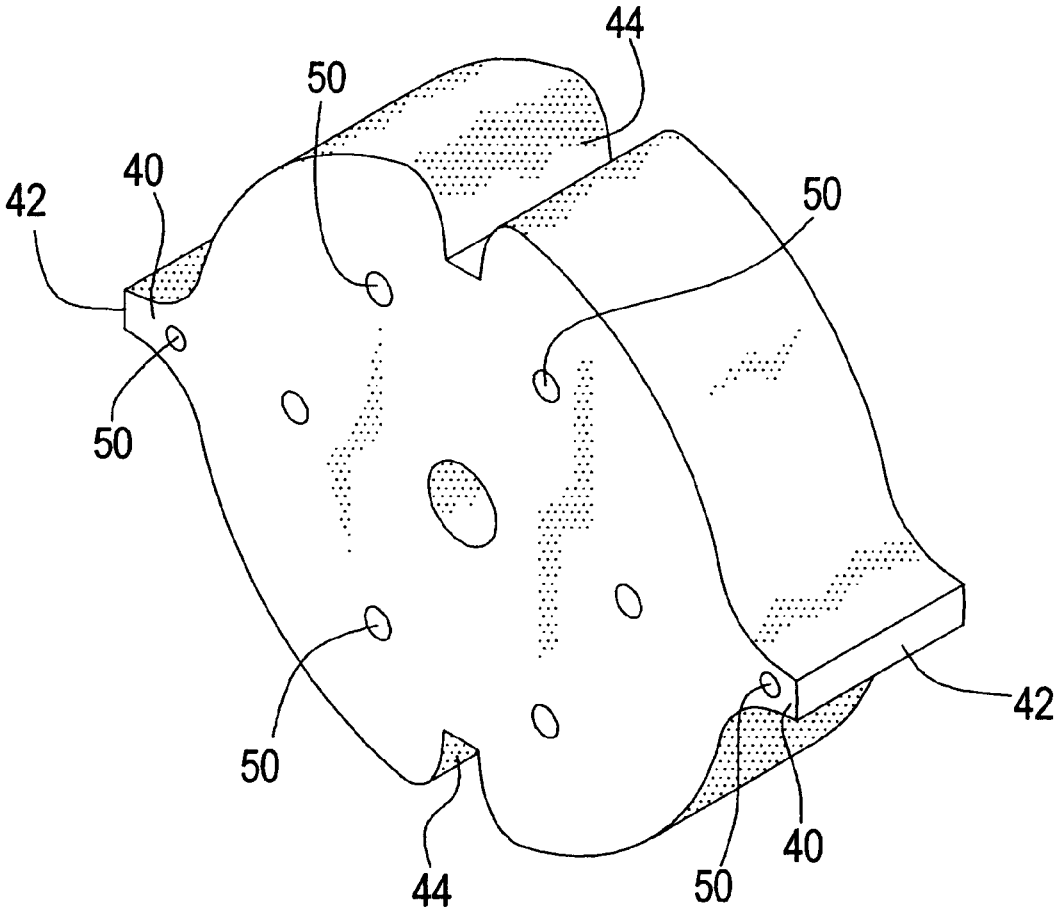
FIG. 3 is an elevated view in perspective of a rotor from the engine of FIG. 1.

Referring now to the drawings, FIGS. 1–3 illustrate a preferred embodiment of this invention. In particular FIG. 1 illustrates a cross-sectional view illustrating the flow of fluid through a continuous combustion engine of this invention. The engine is comprised of a compression stage comprised of a first housing portion 10 which contains three compression sub-stages C1, C2 and C3 which are in series, a combustion unit 30, and an expansion stage comprised of a second housing portion 20 containing three expansion sub-stages E1, E2 and E3 which are in series. Each of compression sub-stages C1, C2 and C3 comprises a respective pair of overlapping cylindrical bores 12, 14, and 16, and a respective pair of cylindrical compression rotors 11, 13, and 15, which are disposed within first housing portion 10 and are concentrically aligned within the corresponding pairs of bores 12, 14, and 16 so that each rotor of each pair of compression rotors 11, 13, and 15 is in substantially sealing relation with the other rotor with which it is paired. In each compression sub-stage, this sealing relationship is maintained where the corresponding rotors in a given pair are in closest proximity to, or actual contact with, one another. The compression stage is configured to receive a fluid volume FV through a fluid inlet 18 in first housing portion 10, compress fluid volume FV, and convey at least a portion of fluid volume FV in compressed form to combustion unit 30, where volume FV is mixed with combustible fuel (e.g., a combustible solid, liquid, or gas) and combustion is ignited to produce an expanding combustion volume CV.

As may be seen in FIG. 1, each of expansion sub-stages E1, E2 and E3 comprises a respective pair of overlapping cylindrical bores 22, 24 and 26, and three pair of cylindrical expansion rotors 21, 23 and 25, disposed within second housing portion 20 and concentrically aligned within bores 22, 24 and 26, respectively, so that each rotor of each pair of expansion rotors 21, 23 and 25 is in substantially sealing relation with the other rotor with which it is paired. The expansion stage is configured to receive expanding combustion volume CV from combustion unit 30 and to convey combustion volume CV out of second housing portion 20 through an exhaust port 28, combustion volume CV imparting a force to expansion rotors 21, 23 and 25 so as to urge expansion rotors 21, 23 and 25 to rotate. Second housing portion 20 and associated expansion rotors 21, 23 and 25 are preferably configured to be cooled by a fluid which is circulated through a plurality of passageways 50 (FIGS. 2 and 3 only) within the housing portion 20 and, preferably, also within the rotors 21, 23 and 25. Most preferably, the lobes of each expansion stage rotor are of sufficient size to define additional passageways 50 through which fluid may flow for purposes of cooling.

As may be seen with particular reference to FIGS. 2 and 3, each of the compression and expansion rotors in the engine is comprised of two male lobes 40,40 diametrically opposed from one another, each of lobes 40,40 extending the entire axial length of their respective rotor and extending radially from the rotor's axis of rotation and beyond the rotor's pitch diameter so as to form a lobe plateau 42 which is in close proximity to an adjacent cylindrical bore surface 50 which surrounds the rotor. Each of the rotors further defines two female grooves 44,44 extending inwardly toward the rotor's axis of rotation from their respective rotor's pitch diameter, the grooves 44,44 of each rotor being diametrically opposed from one another and configured for receiving a respective lobe 40 from the adjacent rotor during rotation of the rotors. Each groove 44 is also circumferentially disposed approximately 90° from an adjacent lobe 40. In this way, as a corresponding pair of rotors rotates (as in the direction of arrows on FIG. 2), the outer surfaces of the rotors at the respective pitch diameters are maintained in substantially sealing relation, the seal being maintained even while lobe 40 of one of the pair of rotors engages and then disengages a corresponding groove 44 on the other of the pair of rotors. The plateau 42 is also in sufficient proximity to, or in contact with, the surface of the corresponding cylindrical bore to create a seal there between. Preferably, plateau 42 of each lobe 40 is not in actual contact with the adjacent bore surface, but is sufficiently machined so as to be in sufficient proximity to such surface during use so as to maintain a seal between plateau 42 and the surface, using tolerances which take into account thermal expansion and contraction during use of the engine. In this way, the rotors and the housing bores of each sub-stage define a volume which is efficiently displaced with rotor rotation.

As may be seen with reference to FIG. 1, in the preferred embodiment depicted, a portion of the compressed fluid volume from the compression stage is circulated through passageways in at least a portion of the second housing portion, and more preferably also through passageways 50 (FIG. 3 only) the corresponding expansion rotors, thereby absorbing and dissipating heat generated by the presence of combustion volume CV in the expansion stage. In a particularly advantageous feature of the embodiment depicted, the diverted compressed fluid volume which flows through passageways in second housing portion 20 and rotor pairs 21, 23 and 25 is recycled back into expansion sub-stage E3, for example, to maximize conversion of thermal expansion energy into mechanical energy via expansion stage rotor pairs 21, 23, and 25. This engine thus has the ability to extract at least some of the thermal energy acquired in the cooling of the combustion chamber and the primary expansion stages by injecting this heated fluid into the later expansion stages. The efficient cooling of these highly thermally stressed components not only allows the use of less expensive materials but also converts some of that thermal energy into mechanical energy.

In the preferred embodiment depicted in the figures, both the compression and expansion stages are multi-staged. However, as will now be appreciated, one or both of the compression and expansion stages of the engine of this invention may be single or multi-staged. Likewise, although on account of sequentially decreasing axial length of each rotor in the serial pairs of rotors the compression sub-stages in the preferred embodiment depicted have progressively smaller fluid clearance volumes, and likewise the expansion sub-stages have progressively larger fluid clearance volumes because of sequentially increasing axial length of each rotor in the serial pairs of rotors, there may be circumstances in which a different configuration with respect to clearance volume, either on the compression or expansion side, would be desirable. As will also now be appreciated, the compression volume within each stage or sub-stage may also be varied through modification of the diameter of either the cylindrical bores or the rotors therein. Moreover, while the rotors of a given pair of rotors depicted in the accompanying figures are symmetrical with respect to their lobes and grooves configuration, and with respect to respective pitch diameters, it will be understood that the rotors may be asymmetrical in either respect, or in both respects. That is, one rotor may just have lobes while the other has just grooves, or both may have lobes and grooves. Likewise, the pitch diameter of any one rotor may be different from the pitch diameter of another (or any other) rotor in the rotor group. In any event, all such configurations as would be apparent to those of ordinary skill in the art having benefit of this disclosure are within the scope of this invention. Even so, in the preferred embodiment depicted, the configuration employed enables the fluid volume to be compressed in the compression stage in a particularly efficient manner while the energy released by the combustion volume also is converted into mechanical energy in a particularly efficient manner.

The fluid displaced by the compression and expansion stages of the engine of this invention may be circulated through the engine via an open cycle (e.g., air in and exhaust out) or a closed cycle (e.g., recycled inert fluid, e.g., helium, recycled through both stages of the engine), as desired.

To the extent practicable, the axes of rotation for the respective rotors of this invention preferably are aligned with one another to increase mechanical simplicity and to reduce cost, although configurations in which some or all of the axes of rotation are not aligned with other rotor axes of rotation are within the scope of this invention. Moreover, it is preferable that the lobes of the rotors, and in particular the lobes of the expansion stage rotors, be sufficiently sized to permit effective circulation of cooling fluid through passageways therein. It may also be preferable under the proper circumstances to configure the lobes of the rotors to be attached to or inserted into the rotor body during construction, so as to employ multi-piece rotor construction as opposed to a unitary or one piece construction. Especially with regard to rotors in the expansion stage, the lobes can be the portion of the rotor subjected to the greatest thermal stresses. Multi-piece construction thus may allow the use of more heat-resistant materials in the construction of the lobes, while using more economical materials for the rest of the rotor body where heat-resistance is not as crucial. Configuring the lobes to be detachable from the rotor body could also enable replacement of worn or excessively stressed lobes without replacement of an entire rotor. Economic benefits in the construction and repair of the rotors may also be realized from these configurations.

It will also be appreciated that the lobes depicted in the accompanying drawings illustrate lobes and grooves which have longitudinal axes which are parallel to the rotational axis of their respective rotor. It should also be appreciated, however, that a geometry could be used to configure the lobes and grooves such that each longitudinal axis of a lobe or groove forms an imaginary helical segment around the respective rotational axis.

This invention is susceptible to considerable variation in its practice. Therefore, the foregoing description is not intended to limit, and should not be construed as limiting, the invention to the particular exemplifications presented herein above. Rather, what is intended to be covered is as set forth in the following claims and the equivalents thereof permitted as a matter of law.

I claim:

1. A combustion engine comprised of (i) at least one compression stage, (ii) at least one combustion unit, and (iii) at least one expansion stage, wherein:

a) the compression stage is comprised of a first housing portion defining two or more overlapping cylindrical bores and two or more cylindrical compression rotors which are disposed within the first housing portion and concentrically aligned within the bores respectively so that the compression rotors are in substantially sealing relation with one another at their respective pitch diameters, the compression stage being configured to (1) receive a fluid volume through a fluid inlet in the first housing portion, (2) compress the fluid volume, and (3) convey at least a portion of the compressed fluid volume to the combustion unit, and b) the expansion stage is comprised of a second housing portion defining two or more overlapping cylindrical bores and two or more cylindrical expansion rotors which are disposed within the second housing portion and concentrically aligned within the bores respectively so that the expansion rotors are in substantially sealing relation with one another at their respective pitch diameters, the expansion stage being configured to receive an expanding combustion volume from the combustion unit and to convey the combustion volume out of the second housing portion through an exhaust port, the combustion volume imparting a force to the expansion rotors, the force urging the expansion rotors to rotate.

2. A combustion engine according to claim 1 wherein the second housing portion and associated expansion rotors are cooled by a circulating fluid.

3. A combustion engine according to claim 1 wherein each of the compression and expansion rotors is comprised of at least two male lobes diametrically opposed from one another, each lobe extending the entire axial length of its associated rotor and extending radially from the rotor axis of rotation beyond the rotor pitch diameter so as to be in sufficiently close proximity to an adjacent surface of the respective cylindrical bore so that a seal may be formed between the lobe and the adjacent surface of the respective cylindrical bore during rotor rotation.

4. A combustion engine according to claim 3 wherein each of the rotors further defines at least two female grooves extending inwardly toward the rotational axis from their respective rotor pitch diameter, the grooves of each rotor being diametrically opposed from one another and configured for receiving a respective lobe on the adjacent rotor.

5. A combustion engine according to claim 4 wherein each of the female grooves is circumferentially disposed in the range of about 0° to about 90° from an adjacent lobe.

6. A combustion engine according to claim 5 wherein each of the female grooves is circumferentially disposed in the range of about 45° to about 90° from an adjacent lobe.

7. A combustion engine according to claim 6 wherein each of the female grooves is circumferentially disposed about 90° from an adjacent lobe.

8. A combustion engine according to claim 1 wherein a portion of the compressed fluid volume from the compression stage is circulated through at least a portion of the second housing portion.

9. A combustion engine according to claim 8 wherein a portion of the compressed fluid volume from the compression stage is circulated through at least one of the corresponding expansion rotors.

10. A combustion engine according to claim 1 wherein the fluid volume displaced by the engine may be circulated through the engine via an open cycle.

11. A combustion engine according to claim 1 wherein the fluid volume displaced by the engine may be circulated through the engine via a closed cycle.

12. A combustion engine according to claim 1 wherein the compression stage is comprised of a series of two or more compression sub-stages, the compression sub-stages being comprised of progressively smaller clearance volumes, each clearance volume being defined by the respective sub-stage overlapping housing bores and the corresponding compression rotors therein.

13. A combustion engine according to claim 12 wherein the expansion stage is comprised of a series of two or more expansion sub-stages, the expansion sub-stages being comprised of progressively larger clearance volumes, each clearance volume being defined by the respective sub-stage overlapping housing bores and the corresponding expansion rotors therein.

14. A combustion engine according to claim 13 wherein each of the compression and expansion rotors is comprised of at least two male lobes diametrically opposed from one another, each lobe extending the entire axial length of its associated rotor and extending radially from the rotor axis of rotation beyond the rotor pitch diameter so as to be in sufficiently close proximity to an adjacent surface of the respective cylindrical bore so that a seal may be formed between the lobe and the adjacent surface of the respective cylindrical bore during rotor rotation.

15. A combustion engine according to claim 14 wherein each of the rotors further defines at least two female grooves extending inwardly toward the rotational axis from their respective rotor pitch diameter, the grooves of each rotor being diametrically opposed from one another and configured for receiving a respective lobe on the adjacent rotor.

16. A combustion engine according to claim 15 wherein a portion of the compressed fluid volume from the compression stage is circulated through at least a portion of the second housing portion.

17. A combustion engine according to claim 16 wherein a portion of the compressed fluid volume from the compression stage is circulated through at least one of the corresponding expansion rotors.

18. A combustion engine according to claim 15 wherein the fluid volume displaced by the engine may be circulated through the engine via an open cycle.

19. A combustion engine according to claim 15 wherein the fluid volume displaced by the engine may be circulated through the engine via a closed cycle.

20. A combustion engine according to claim 1 wherein the expansion stage is comprised of a series of two or more expansion sub-stages, the expansion sub-stages being comprised of progressively larger clearance volumes, each clearance volume being defined by the respective sub-stage overlapping housing bores and the corresponding expansion rotors therein.

21. A combustion engine according to claim 1 wherein the rotors of at least one pair of rotors are asymmetrical with respect to their respective lobe and groove configuration and/or pitch diameters.

22. A method of imparting rotational force to a drive shaft, the method comprising:

a) introducing a fluid volume into a compression stage comprised of a first housing portion which defines two or more overlapping cylindrical bores and two or more cylindrical compression rotors disposed within the first housing portion and concentrically aligned within the bores respectively so that the compression rotors may be in substantially sealing relation with one another at their respective pitch diameters during rotation, b) compressing the fluid volume, c) conveying at least a portion of the compressed fluid volume to a combustion unit, wherein the compressed fluid volume is mixed with a fuel which is then ignited to form an expanding combustion volume, d) introducing the expanding combustion volume into an expansion stage comprised of a second housing portion defining two or more overlapping cylindrical bores and two or more cylindrical expansion rotors which are disposed within the second housing portion and concentrically aligned within the bores respectively so that the expansion rotors may be in substantially sealing relation with one another at their respective pitch diameters during rotation, the expansion rotors being operatively coupled to the drive shaft so that rotation of the expansion rotors urges rotation of the drive shaft, and e) conveying the expanding combustion volume through the second housing portion exhaust port while the combustion volume imparts a force to the expansion rotors urging the rotors to rotate.

23. A method according to claim 22 wherein the compression stage is comprised of a series of two or more compression sub-stages, the compression sub-stages being comprised of progressively smaller clearance volumes, each clearance volume being defined by respective sub-stage overlapping housing bores and the corresponding compression rotors therein.

24. A method according to claim 23 wherein the expansion stage is comprised of a series of two or more expansion sub-stages, the expansion sub-stages being comprised of progressively larger clearance volumes, each clearance volume being defined by respective sub-stage overlapping housing bores and the corresponding expansion rotors therein.

* * * * *

UNITED STATES PATENT AND TRADEMARK OFFICE

CERTIFICATE OF CORRECTION

PATENT NO. : 6,273,055 B1
DATED : August 14, 2001
INVENTOR(S) : Robert A. White

It is certified that error appears in the above-identified patent and that said Letters Patent is hereby corrected as shown below:

Column 3,
Line 57, replace "50" with -- 52 --.

Column 4,
Line 20, following "(Fig. 3 only)" insert -- in --.
Line 25, following "passageways" insert -- 54 --.

Signed and Sealed this

Seventeenth Day of September, 2002

*Attest:*

*Attesting Officer*

JAMES E. ROGAN
*Director of the United States Patent and Trademark Office*